US005102303A

United States Patent [19]

Gobaud

[11] Patent Number: 5,102,303

[45] Date of Patent: Apr. 7, 1992

[54] HYDRAULIC RAM

[76] Inventor: Michel Gobaud, Ile Gaudy, 16120 Chateauneuf, France

[21] Appl. No.: 613,648

[22] PCT Filed: Apr. 3, 1990

[86] PCT No.: PCT/FR90/00231

§ 371 Date: Jan. 14, 1991

§ 102(e) Date: Jan. 14, 1991

[87] PCT Pub. No.: WO90/12211

PCT Pub. Date: Oct. 18, 1990

[30] Foreign Application Priority Data

Apr. 3, 1989 [FR] France ..... 89 04492

[51] Int. Cl.[5] ..... F04F 7/02; F04F 7/00; F15B 13/02

[52] U.S. Cl. ..... 417/226; 417/240; 91/49

[58] Field of Search ..... 417/226, 240; 91/49

[56] References Cited

U.S. PATENT DOCUMENTS 1,364,617 1/1921 Daynix ..... 417/240
2,424,108 7/1947 Merten ..... 91/49

*Primary Examiner*—Richard A. Bertsch
*Assistant Examiner*—Alfred Basichas
*Attorney, Agent, or Firm*—Roylance, Abrams, Berdo & Goodman

[57] ABSTRACT

A hydraulic ram includes a water inlet conduit, a draining conduit with a main clapper valve and a bell or cup valve. The bell or cup valve communicates with the chamber through a plurality of individual clapper arranged parallel to one another. Each of the individual clapper valves block one passage orifice. The bell or cup valve has a water backflow outlet connection. The individual clapper valves include spheres of resilient material located adjacent seats arranged in a wall separating the chamber from the bell or cup valve. The wall includes separating barriers and a perforated back-up plate. The draining conduit is arranged vertically under the chamber. The main clapper defines a vertical axis extending into the chamber and is mounted slidably in a stationary bearing, while being pulled back constantly and elastically into a top open position of the main clapper valve. The main clapper valves also includes an element serving as a shock absorber for an end of a downstroke.

4 Claims, 2 Drawing Sheets

HYDRAULIC RAM

The present invention discloses an improved hydraulic ram.

Hydraulic rams have been known for a long time. As known, they are water elevator devices utilizing shock forces or impact forces in a conduit which is abruptly closed (by ram thrust) to force part of the liquid volume therein the rise to higher level than the height of the fall or drop.

The devices, however, until this time have been characterized by a small yield when the water is flowing rapidly.

The object of the present invention is precisely to improve the known device particularly regarding this point.

The object of the invention then is a hydraulic ram of the type comprising a chamber, a water inlet conduit, a draining conduit provided with a clapper valve and a bell or cup valve communicating with said chamber by means of a valve system and provided with a backflow water outlet, characterized in that said valve system is constituted of a plurality of individual clapper valve arranged parallel to one another, each of which is capable of blocking a passage orifice in a wall separating said chamber from said bell or cup valve, said clapper valves being provided on the same side of said wall as the bell or cup valve.

According to another characteristic of the device of the invention, the draining conduit is located vertically under the chamber of the ram and the clapper valve of the draining conduit presents a vertical axis extending into the chamber and mounted sliding in a stationary bearing and being pulled back continuously and elastically into top open position as it controls the clapper valve, while said clapper valve in addition comprises a shock absorbing element for the end of the downstroke.

It is advantageous that said clapper valve be provided in a venturitype conduit, slightly upstream from the narrowest section of the conduit, and that a rubber washer be provided at the point of contact between the clapper valve and its seat.

According to still another characteristic, a filtering screen is interposed between the chamber of the ram and the bell or cup valve in such a manner as to be tangent with the water inlet conduit.

Finally, the water inlet conduit advantageously comprises a cross section which extends broadening out in the direction of the ram chamber and the water inlet conduit is formed of two half-conduits provided with lateral fixation straps which are superposed in the joining surface of the half-conduits, said straps being integral with the anchoring clamp bearings of the ram in an appropriate fixing structure.

Other characteristics and advantages arise from the following description of one embodiment of the device according to the invention, the description given solely as an example and relating to the attached drawings, wherein.

Figure 1:
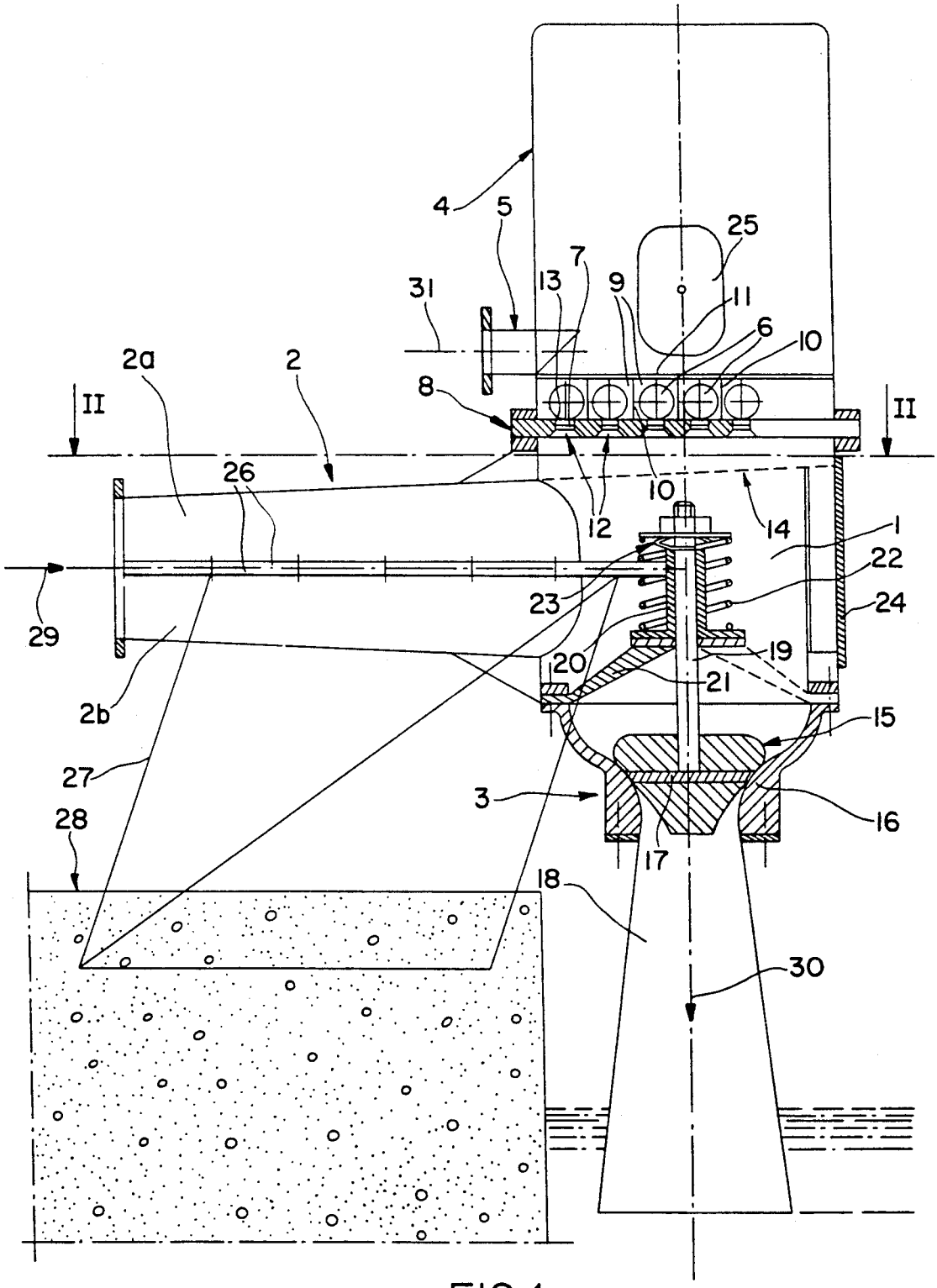
FIG. 1 is a vertical axis section through a ram according to the invention.
Figure 2:
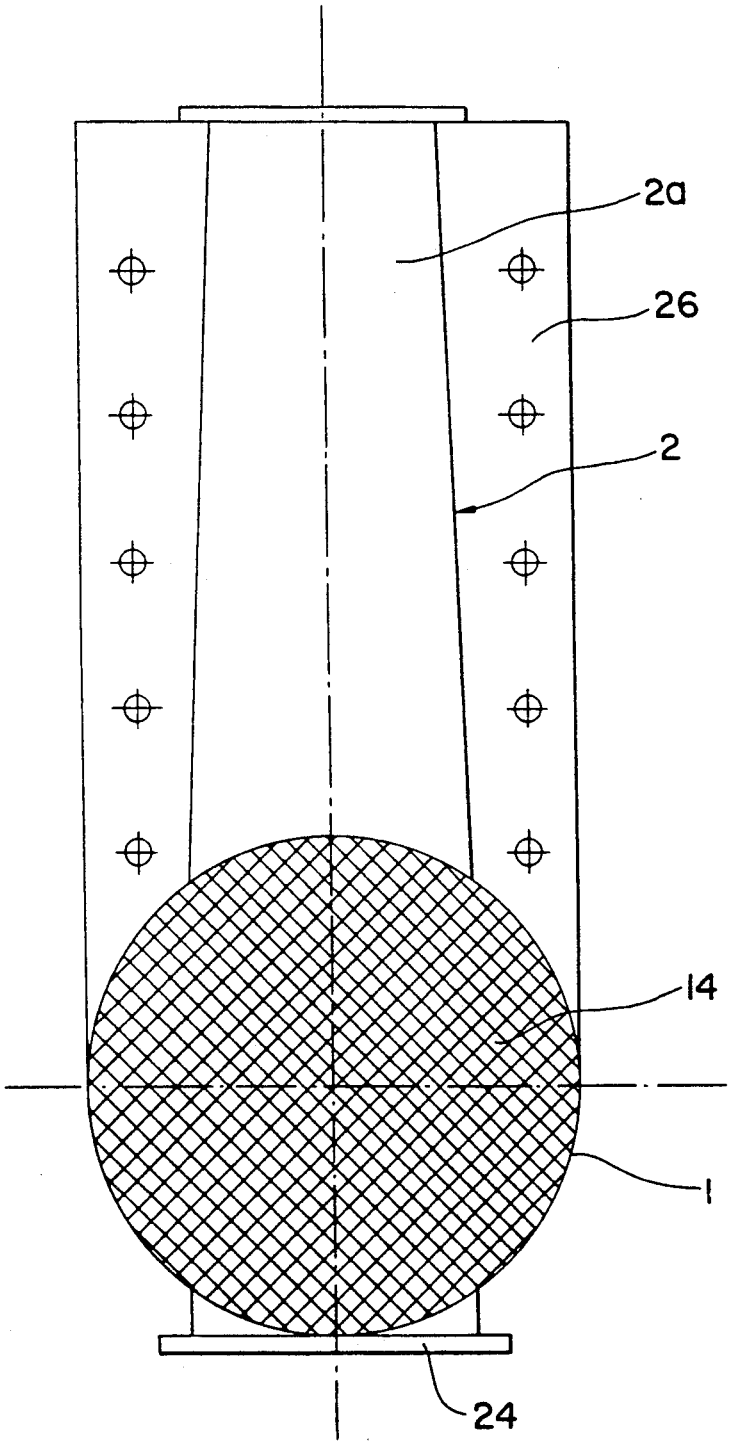
FIG. 2 is a plan view along the line II—II of the device shown in FIG. 1.

The ram shown in the drawings comprises a cylindrical chamber 1 with vertical axis, provided with a horizontal water inlet conduit 2, a vertical draining conduit 3 arranged below chamber 1 and a cylindrical bell or cup valve 4 arranged above chamber 1 and provided with a water backflow outlet connection 5.

According to the invention, a valve system is arranged at the interface between chamber 1 and bell or cup valve 4 and the valve system is constituted of a plurality of clapper valves in the form of spheres 6 arranged parallel to one another and with each sphere facing a circular orifice 7 which the sphere is capable of blocking. The orifices or seats 7 are formed in a relatively thick plate 8 affixed in the interface surface between bell or cup valve 4 and chamber 1.

Spheres 6 are arranged on the side of plate 8 opposite chamber 1. Each sphere has a certain degree of freedom of movement in such a fashion as to be able to block its seat or on the other hand to remove itself from said seat sufficiently to allow a certain water flow to pass by.

For this, each sphere 6 is confined in a space 9 defined by separating barriers 10 and a perforated back-up plate 11 which may for example be pierced with a multitude of holes (not shown). So as to improve the passage of water at the point of the orifices in plate 8, the passage cross sections 12 in this plate are in the form of venturi passages, the seat 13 of each sphere 6 being approximately in the shape of a truncated cone. For example, it is possible to provide about fifty spheres 6 of on the order of 70 mm diameter.

Spheres 6 are advantageously of rubber or the like so as to limit noises of their impacts against walls 10, 11 and plate 8.

In chamber 1, a separation screen 14 between chamber 1 and bell or cup valve 4 is arranged in the vicinity of plate 8, where it is intended to filter the water, this screen 14 being arranged in the extension of conduit 2 with which it is tangent particularly at the point of the top generatrix.

A clapper valve of vertical axis is arranged in chamber 1 coaxial with draining conduit 3. This clapper valve comprises an obturation element 15 of generally truncated conical shape, which can engage against an annular seat 16 supported by conduit 3. More precisely, this conduit has a generally venturi shape with a minimum diameter cross section immediately downstream from said seat 16.

A ring 17 of rubber or the like is attached to member 15 at the contact zone to reduce the noise of the impacts of member 15 on its seat 16. It would be possible of course to reverse the arrangement by mounting ring 17 on seat 16. The part 18 of conduit 3 which extends broadening out from that point forms a diffuser.

Blocking element 15 is affixed at the end of a vertical axis 19 mounted sliding in a sleeve 20 fixed by arms 21 to the wall of the chamber of the ram.

Element 15 is pulled back constantly into top position, at some distance from seat 16, by a spring 22, while at the end of the downstroke of the clapper valve a shock absorbing element, such as for instance a Belleville washer 23, is interposed between sleeve 20 and the end of axis 19.

The inside of chamber 1 is made accessible by means of a lateral trap door 24.

The inside of bell or cup valve 4 is accessible through an observation port 25.

Finally, still in accordance with the invention, the water inlet conduit 2 is constituted of two half-conduits **2*a*, 2*b* which are superposed and provided with lateral straps 26 for fixation of the half-conduits and fixation of the ram on two clamp bearings or lateral anchoring plates 27, these anchored in a block of concrete 28** or in any appropriate fixing structure for the ram.

Conduit 2 extends broadening out slightly in its cross section in the direction of chamber 1.

The ram operates according to the generally well known principle to a ram.

When clapper valve 15 is in top open position (rest position), the water arrives at 29 through conduit 2, passes through chamber 1 and escapes through the open clapper valve, flowing (arrow 30) into the outside environment via diffuser 18.

The flow of the water at accelerating speed in the vicinity of blocking element 15 causes the clapper valve to close (bottom position, shown in FIG. 1).

The kinetic energy of the mass of water abruptly halted upstream of the clapper valve is transformed by very high instantaneous pressure (thrust of the ram) which forces the water in chamber 1 to overcome the pressure exerted on spheres 6 which are then located in contact with their seat 13, and to pass into bell or cup valve 4 by lifting the spheres from their seats until the pressures are equalized on the two sides of plate 8.

Spheres 6 then return to their positions blocking seats 13.

Besides, since the pressure in chamber 1 has diminished, blocking element 15 returns to top position under the effect of spring 22 which then also produces a new drainage at the point of the clapper valve and the cycle recommences.

Upon each raising of spheres 6 from their seats a certain volume of water is thrust (arrow 31) through backflow outlet conduit 5.

The noises of the banging of the valve in particular when it closes are essentially absorbed by ring 17 and by the Belleville washer 23.

With the provision of a large number of clapper valve spheres 6 mounted parallel to one another, in a very short lapse of time it is possible to cause a very obviously greater volume of water to pass during each closing of clapper valve 15 than that which passes in an ordinary valve arrangement of a traditional hydraulic ram.

The flow yield is still further improved by the configuration of inlet conduit 2 and by the configuration of a venturi-type discharge conduit 3.

Besides, the filtering screen 14 is particularly efficient and reliable because it is cleaned automatically by means of the intermittent sweeping procured by the water following the opening of clapper valve 15, as this screen has its bottom surface in the extension of the top generatrix of conduit 2.

Finally, the invention is obviously not limited to the embodiment shown and described herein but on the contrary covers all variations, particularly those concerning shapes, dimensions and arrangements of the clapper valve elements constituted of spheres 6 which can be replaced by any element which can operate as a clapper valve in the same conditions. The means (barriers 10, 11) to contain each sphere 6 or clapper valve element or the like can also be replaced by other means which fulfill the same function of holding the spheres while also allowing problem-free passage of the water when the valve members are at some distance from their valve seats.

I claim:

1. A hydraulic ram, comprising:

a chamber;

a conduit for water inlet coupled to said chamber;

a bell or cup valve communicating with said chamber through a valve system having a plurality of individual clapper valves arranged parallel to one another, each of said individual clapper valves being capable of blocking one passage orifice, said bell or cup valve being provided with a water backflow outlet connection, said individual clapper valves including spheres of resilient material located adjacent seats arranged in a wall separating said chamber from said bell or cup valve, said wall including separating barriers and a perforated back-up plate; and a draining conduit provided with a main clapper valve and arranged vertically under said chamber, said main clapper valve defining a vertical axis extending into said chamber and being mounted slidably in a stationary bearing while being pulled back constantly and elastically into a top open position of said main clapper valve, said main clapper valve also including an element serving as a shock absorber for an end of a downstroke.

2. A hydraulic ram according to claim 1 wherein said main clapper valve is arranged in a conduit of venturi shape having a narrowest section, a rubber ring being provided adjacent and upstream of the narrowest section at a point of contact between said main clapper valve and a seat therefor.

3. A hydraulic ram according to claim 1 wherein a filtering screen is interposed between said chamber and said bell or cup valve, and is tangent with the water inlet conduit.

4. A hydraulic ram according to claim 1 wherein the water inlet conduit comprises a section which expands in a direction of said chamber and is formed of two half-conduits provided with lateral fixing straps superposed in an interface surface of the half-conduits, said straps being integral with clamp bearings for means for anchoring of the ram in an appropriate structure.

* * * * *